US006295922B1

(12) United States Patent
Salamone et al.

(10) Patent No.: US 6,295,922 B1
(45) Date of Patent: Oct. 2, 2001

(54) IN-LINE FINISHING STACKER WITH UNLOADING PUSHER APPARATUS

(75) Inventors: John Salamone, Kinnelon; Gregory Balcerek, Wayne, both of NJ (US); Leakat Hanif, Flushing, NY (US)

(73) Assignee: Nu-Tech Printing Machinery, Inc., Paterson, NJ (US)

( * ) Notice: Subject to any disclaimer, the term of this patent is extended or adjusted under 35 U.S.C. 154(b) by 0 days.

(21) Appl. No.: 09/522,239

(22) Filed: Mar. 9, 2000

(51) Int. Cl.[7] ..... B65B 27/08

(52) U.S. Cl. ..... 100/7; 271/182; 414/790.3

(58) Field of Search ..... 100/7, 4; 271/182, 271/202; 414/789.1, 790.3, 793.8

(56) References Cited

U.S. PATENT DOCUMENTS

| | | | | |
|---|---|---|---|---|
| 3,768,382 | * | 10/1973 | Zernov et al. | 271/182 |
| 3,905,595 | | 9/1975 | Adams et al. . | |
| 3,995,540 | * | 12/1976 | Huiskes | 271/182 |
| 3,998,141 | * | 12/1976 | Hsiue | 271/182 |
| 4,040,618 | | 8/1977 | Vermes et al. . | |
| 4,111,411 | | 9/1978 | Graves et al. . | |
| 4,200,276 | | 4/1980 | Marschke . | |
| 4,313,600 | | 2/1982 | Mosburger . | |
| 4,455,115 | | 6/1984 | Alger et al. . | |
| 4,498,381 | * | 2/1985 | Convey, Jr. | 100/7 |
| 4,538,511 | * | 9/1985 | Wise | 100/7 |
| 4,598,901 | | 7/1986 | Thomas . | |
| 4,805,890 | | 2/1989 | Martin . | |
| 4,824,093 | | 4/1989 | Belden . | |
| 4,867,434 | | 9/1989 | Cogswell et al. . | |
| 4,902,184 | * | 2/1990 | Fritz | 414/790.3 |
| 4,948,114 | | 8/1990 | Bowman et al. . | |
| 5,054,765 | | 10/1991 | Henn et al. . | |
| 5,098,079 | | 3/1992 | Sanborn, III . | |
| 5,158,278 | | 10/1992 | Auf der Mauer . | |
| 5,249,790 | * | 10/1993 | Brame et al. | 271/182 |
| 5,476,253 | | 12/1995 | Takemoto et al. . | |
| 5,611,529 | | 3/1997 | Richarz et al. . | |
| 5,626,336 | | 5/1997 | Adami . | |
| 5,664,770 | | 9/1997 | Keller . | |

* cited by examiner

*Primary Examiner*—Stephen F. Gerrity

(57) ABSTRACT

A bundling system can convert a shingled stream of goods into successive bundles of goods. The system has a conveyor assembly with an upstream and a downstream section for (a) longitudinally passing the shingled stream of goods from the upstream to the downstream section, and (b) repeatedly interrupting passage of goods for creating a gap in the shingled stream of goods. The system also includes a reciprocatable table located downstream of the conveyor assembly for detaining and collecting goods there into a stacked bundle. Also included is a pusher for extending and pushing the stacked bundle off the table. The reciprocatable table is arranged to rise past the pusher without interference when the pusher is extended.

62 Claims, 8 Drawing Sheets

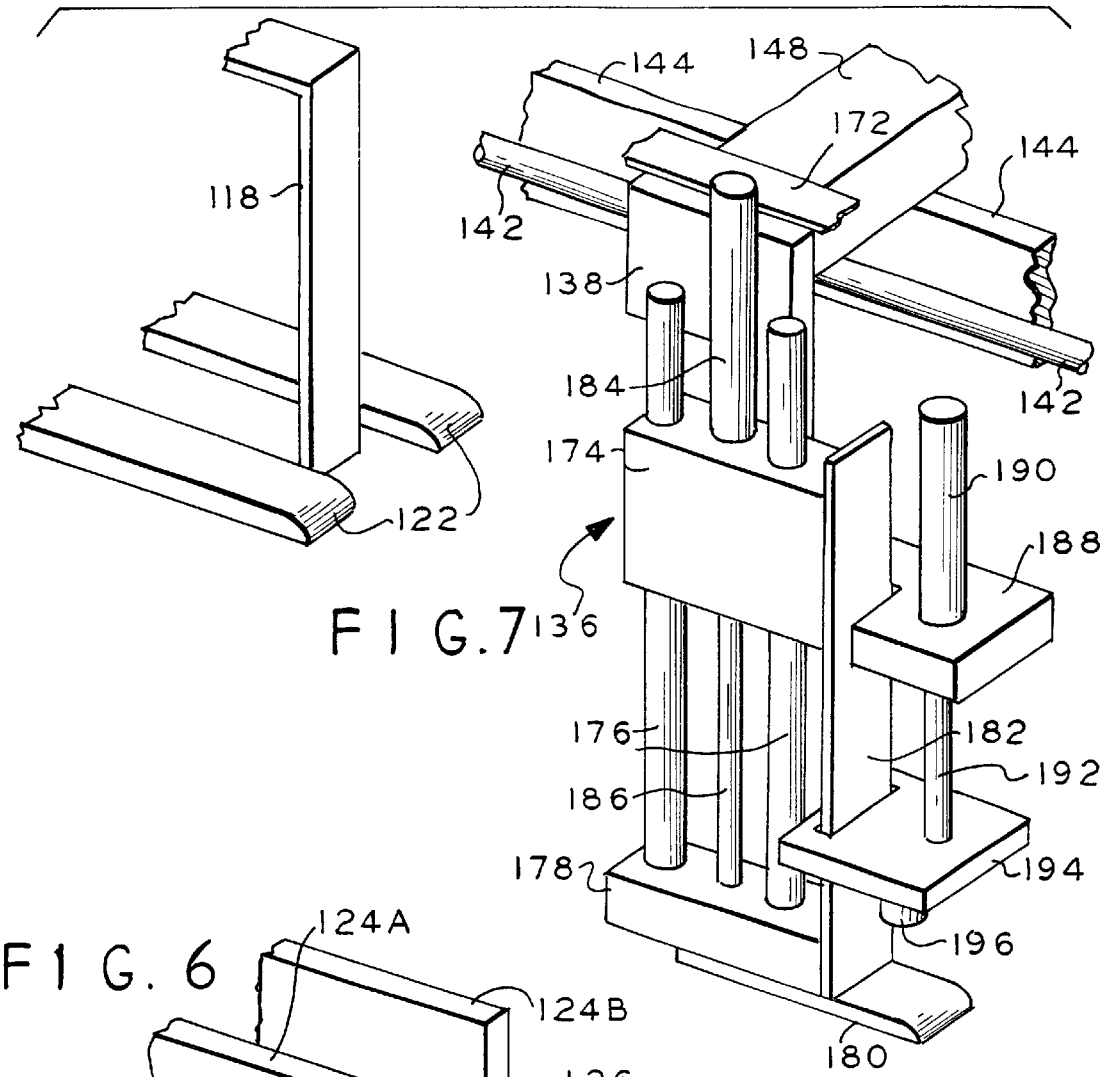
FIG. 7
FIG. 6
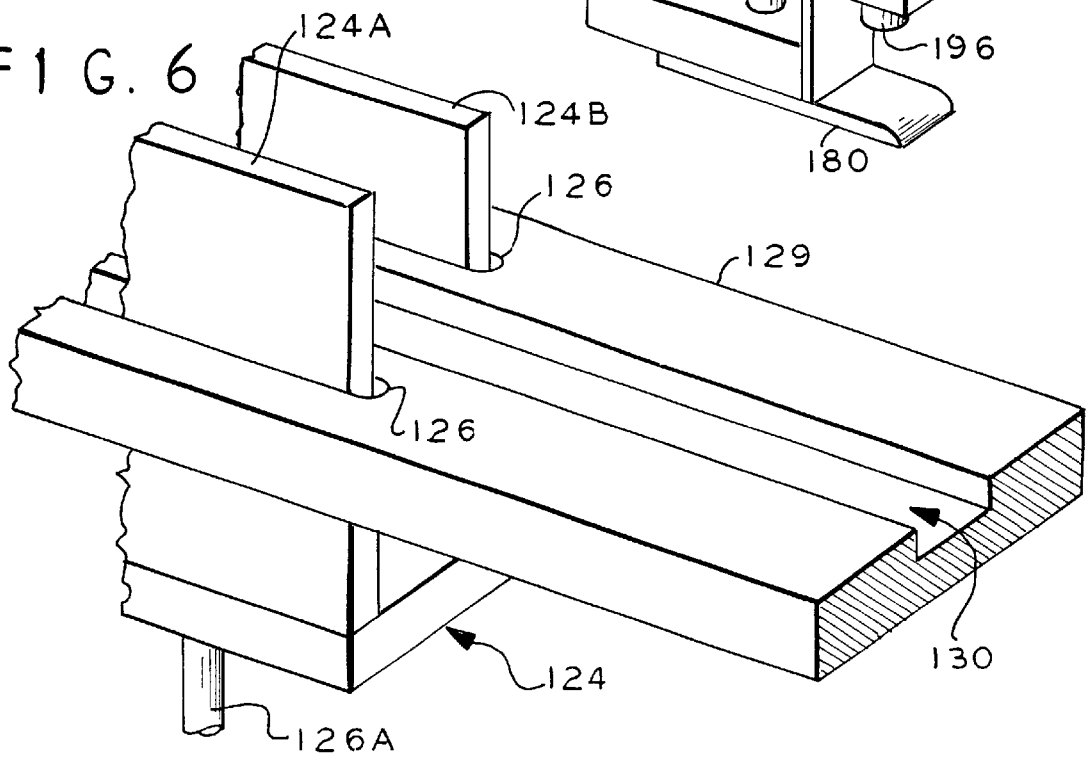

IN-LINE FINISHING STACKER WITH UNLOADING PUSHER APPARATUS

BACKGROUND OF THE INVENTION

1. Field of the Invention

The present invention relates to bundling systems, and in particular, to systems that can convert a shingled stream of goods into successive bundles of goods.

2. Description of Related Art

Goods made of flexible sheets are often produced in a shingled stream. For example, printed cards or labels may be printed on a web and cut by a rotary die that delivers successive sheets onto a relatively slow conveyor belt. Because of this relatively slow speed, successive sheets are placed atop one another to form a staggered or shingled stream. Other types of equipment can also produce shingled streams. For example, booklets can be produced in a shingled stream by a stapling machine or by other binding machines. Other non-paper goods are also produced in a shingled stream.

These shingled streams usually need to be stacked into bundles having a predetermined number of units. Manually counting and separating the stream into a predetermined count is inefficient and impractical, because these shingled streams are delivered too quickly for human handlers.

Accordingly, automated machines have been designed to separate the shingled stream into predetermined bundles, but even these machines have had difficulty accommodating high flow rates. One known bundling technique allows the shingled stream to fall onto a table and form a stack. After reaching a certain height, the stack is pushed toward an automatic banding machine that ties a band around the stack.

Several difficulties exist with this type of machine. The incoming shingled stream continues to fall onto the table while the stack is being pushed away. Goods delivered during this transition period can get caught in the pushing mechanism. Therefore the pushing mechanism must be made extremely fast, but this increases the likelihood of damage to the goods. Also, separating the stream into bundles having a precise count is rather difficult when the shingled stream flows at a relatively high rate and the pusher must act very quickly.

Accordingly, there is a need for a bundling system that can quickly and accurately separate the shingled stream into stacked bundles having an accurate number of units per stack.

SUMMARY OF THE INVENTION

In accordance with the illustrative embodiments demonstrating features and advantages of the present invention, there is provided a bundling system that can convert a shingled stream of goods into successive bundles of goods. The system has a conveyor assembly with an upstream and a downstream section for (a) longitudinally passing the shingled stream of goods from the upstream to the downstream section, and (b) repeatedly interrupting passage of goods for creating a gap in the shingled stream of goods. The system also includes a reciprocatable table located downstream of the conveyor assembly for detaining and collecting goods there into a stacked bundle. Also included is a pusher for extending and pushing the stacked bundle off the table.

According to another aspect of the present invention, a bundling system can also converting a shingled stream of goods into successive bundles of goods. The system has a conveyor assembly for longitudinally passing the shingled stream of goods in a downstream direction. Also included is a reciprocatable table located downstream of the conveyor assembly for detaining and collecting goods there into a stacked bundle. The bundling system also has a pusher for extending and pushing the stacked bundle off the table. The reciprocatable table is arranged to rise past the pusher without interference when the pusher is extended.

By employing equipment of the foregoing type, an improved bundling system is achieved. In a preferred embodiment a shingled stream of goods is conveyed between different sections of a conveyor assembly. The shingled goods are conveyed by the assembly to form a stack on a table that lowers as the stack builds.

Preferably, a gap is formed in the shingled stream by temporarily accelerating the downstream conveyor section and temporarily decelerating the upstream conveyor section. At the same time a blade is inserted into the shingled stream to prevent goods from crossing over to the downstream conveyor section. As the blade descends, a nip roller is also placed at the downstream conveyor section to ensure that goods are positively accelerated.

When the gap in the shingled stream is detected at the table, the preferred table quickly descends. Preferably, a pair of implements are thrust into the position vacated by the retreating table to catch the stream of goods that will resume after the gap. A pusher then pushes the stacked goods off the table. The preferred table has a forked structure that can straddle the pusher mechanism and rise while the pusher is still extended. Thus the table is able to quickly return and is not delayed by the cycling of the pusher.

In the preferred embodiment, the stacked bundle is straightened by a side jogger before being grappled by a robotic arm. This arm has a carriage that moves in an upstream/downstream direction by riding with a linear bearing on a horizontal rail. A preferred scoop can be lowered from the carriage and inserted under the bundle. A preferred gripper can then descend from the carriage onto the top of the stacked bundle, which is then moved forward to, for example, a banding machine.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings, wherein:

FIG. 6 is a detailed, fragmentary, axonometric view of the table of FIG. 1 partially extending through a span;

FIG. 7 is a detailed, fragmentary, axonometric view of the robotic arm and implement of FIG. 1;

DETAILED DESCRIPTION OF THE PREFERRED EMBODIMENTS

Figure 1:
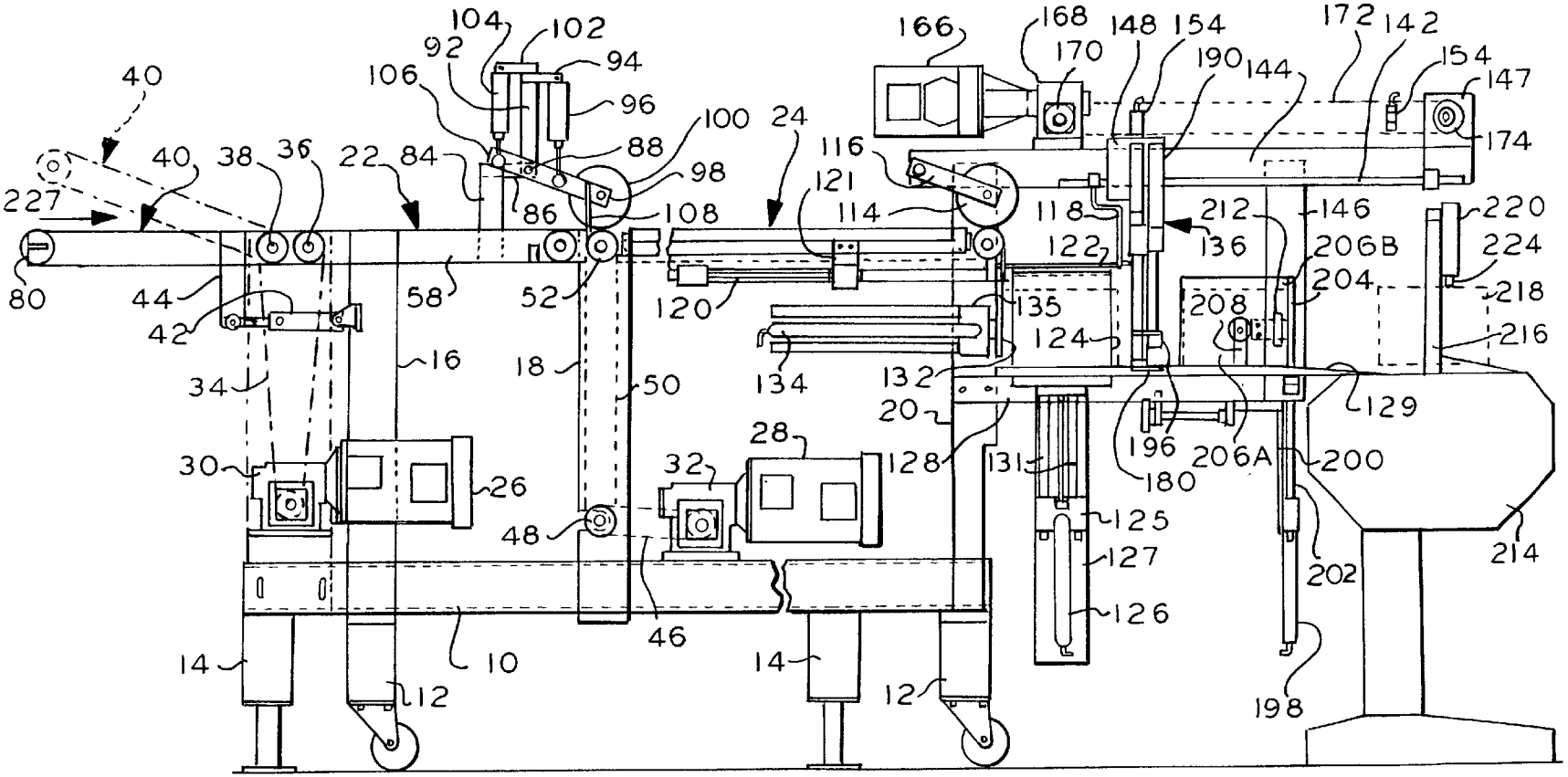
FIG. 1 is side elevational view of a bundling system in accordance with principles of the present invention.

Referring to FIGS. 1–4, the illustrated bundling system has beams 10 supported on caster legs 12 and leveling legs 14. Vertical supports 16, 18 and 20 on beams 10 support a conveyor assembly having an upstream section 22 and a downstream section 24. Sections 22 and 24 are driven by upstream drive motor 26 and downstream drive motor 28, respectively. Motors 26 and 28 are attached to right angle drives 30 and 32, respectively, which are mounted on beam 10. Motors 26 and 28 are normally driven at a speed that corresponds to the rate of delivery of goods onto the conveyor assembly. For this purpose, a speed encoder signal from an upstream process drives a digital to analog converter (not shown) to supply a control signal to an associated frequency inverter (not shown) that controls the speed of the motors.

Drive 30 circulates endless belt 34, which rotates pulley 36 of conveyor section 22 and pulley 38 of loading section 40. The angle of elevation of loading section 40 can be adjusted by air cylinder 42, acting through strut 44, which is attached to the frame of section 40 to rotate therewith. Conveyor section 40 can rotate upwardly to the position illustrated in phantom in order to avoid receiving the stream of shingled goods that will be described presently.

Drive 32 circulates endless belt 46 to drive idler pulley 48 in order to circulate endless belts 50. Belts 50 rotate pulleys 52 to drive conveyor section 24. Endless conveyor belts 66 (FIG. 2) circulate on pulleys 68 and 70. Pulleys 68 are driven by previously mentioned drive pulleys 52.

Figure 3:
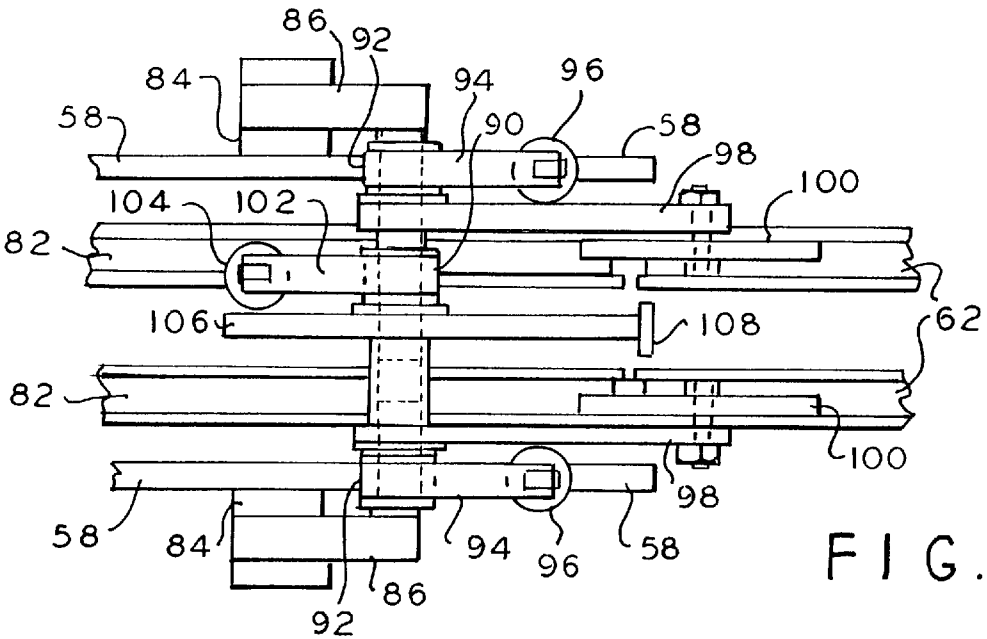
FIG. 3 is a detailed plan view of a portion of the assembly of FIG. 2.

Conveyor section 22 has axles 54 and 56 rotatably mounted in parallel frame members 58 (FIG. 3). Axle 54 is driven by pulley 36 to rotate pulleys 60. Endless parallel conveyor belts 62 circulate around pulleys 60 and 64, the latter being attached to axle 56.

Conveyor section 40 has axles 72 and 74 rotatably mounted in parallel side frame members 76. Axle 72 is driven by previously mentioned pulley 38. Endless conveyor belts 82 circulate on pulleys 78 and 80, which are mounted on axles 72 and 74, respectively.

Figure 4:
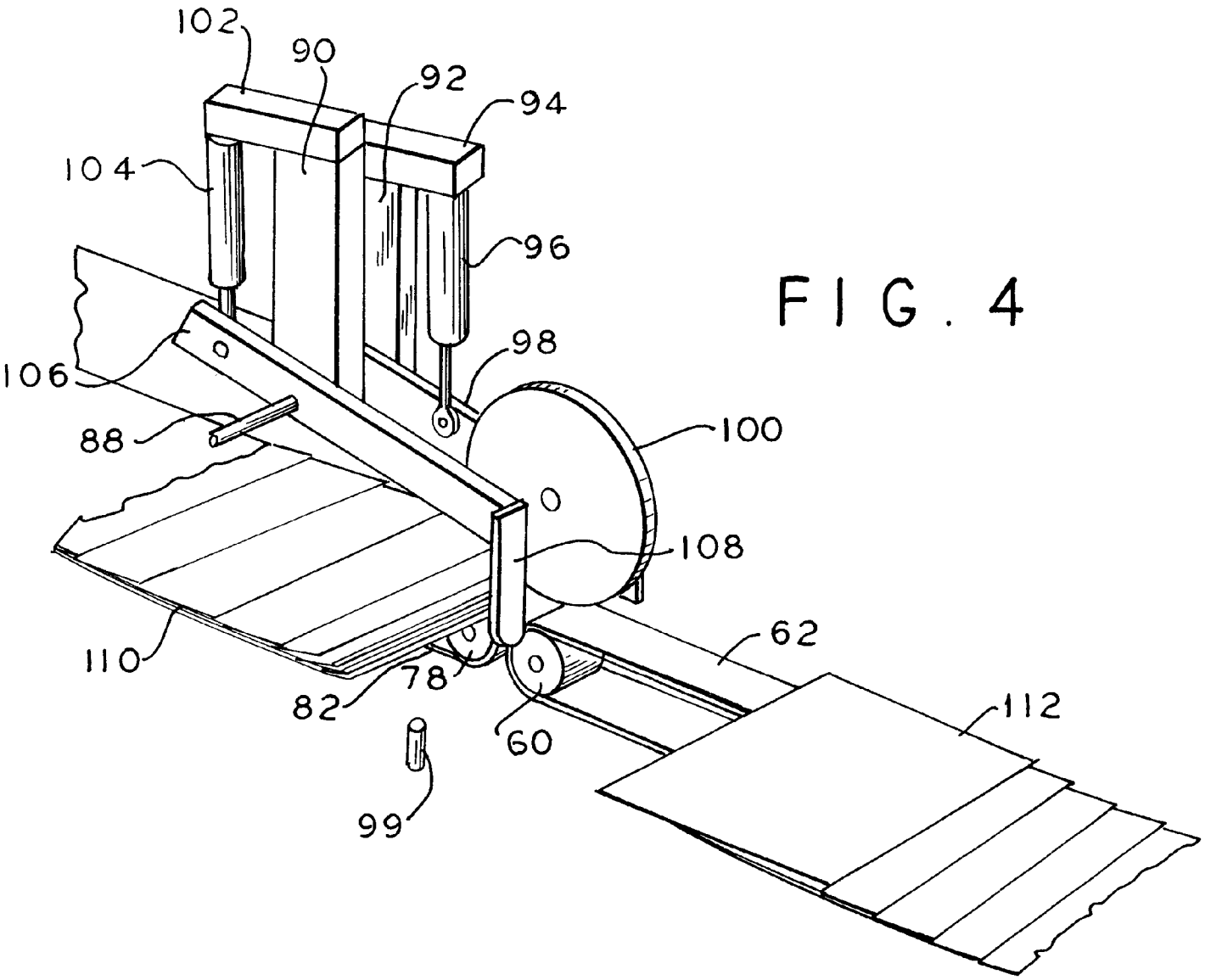
FIG. 4 is a detailed, axonometric view of portions of the conveyor assembly of FIG. 1 with portions removed for illustrative purposes.

A pair of upright supports 84 (FIG. 1) attached to side frames 58 support cantilevered arms 86. A support shaft 88, mounted between arms 86, supports central column 90 and a pair of side columns 92 (FIGS. 3 and 4). Columns 92 support cantilevered arms 94 which extend in the downstream direction and support dependent air cylinder 96. Lever 98 is rotatably supported on shaft 88 and is reciprocated by the air cylinder 96. Lever 98 supports on its distal end a nip roller 100.

Column 90 supports cantilevered arm 102 which extends in the upstream direction and supports dependent air cylinder 104. Cylinder 104 is connected to the upstream end of rocker 106, which rotates about shaft 88. The downstream end of rocker 106 is connected to a reciprocating blade 108.

A shingled stream of goods 110 is shown riding on conveyor belt 82 in FIG. 4. In this view, blade 108 has been lowered to stop the flow of goods 110, allowing the stream of shingled goods 112 to continue to flow downstream on conveyor belts 62. Infrared sensor 99 is shown located in the vicinity of blade 108 below and between conveyor belts 82 in order to sense the arrival of, as well as gaps in, the shingled streams. Sensor 99 has an infrared radiator that sends a beam upwardly between the conveyor belts 82 toward a reflector (not shown) which can return the beam to a detector in sensor 99.

Referring to FIGS. 1 and 5–8, endless conveyor belts 62 are shown overlaid by downstream nip rollers 114, which are mounted on articulated arms 116. A gap sensor 117 is located below conveyor belts 62. Sensor 117 has an infrared radiator that sends a beam upwardly between the conveyor belts 62 toward a reflector (not shown) which can return the beam to a detector in sensor 117. As described further hereinafter, the beam is interrupted when the shingled goods are flowing on conveyor belts 62, except when a gap arrives in the vicinity of sensor 117.

A guide 118 is shown as a blade having a converging upstream section leading to a horizontal midsection, followed by a vertical section. The upstream/downstream position of guide 118 can be adjusted to accommodate the specific size of the stock being delivered by conveyor belts 62. Essentially, guide 118 causes the incoming goods to descend and form a stacked bundle, as will be described presently. As this bundle grows it eventually reaches a height that is detected by capacitive sensor 119. This stacked bundle is jogged on the side by a chrome plate vibrated by a continually operating air motor (neither plate nor motor are shown). The bundle is also jogged from behind by two fingers (not shown) that are spring-loaded away from the bundle. These fingers are periodically driven toward the bundle by a cam (not shown) mounted on the axle of conveyor pulley 70.

Underneath conveyor belts 62 is an air cylinder 120 supported on the structure of conveyor section 24 by plate 121. Cylinder 120 has attached to its piston arm a parallel pair of reciprocating implements 122. Implements 122 horizontally reciprocate between the extended position illustrated in FIG. 5 to a retracted position wherein the implements 122 are completely underneath endless conveyor belts 62.

Figure 5:
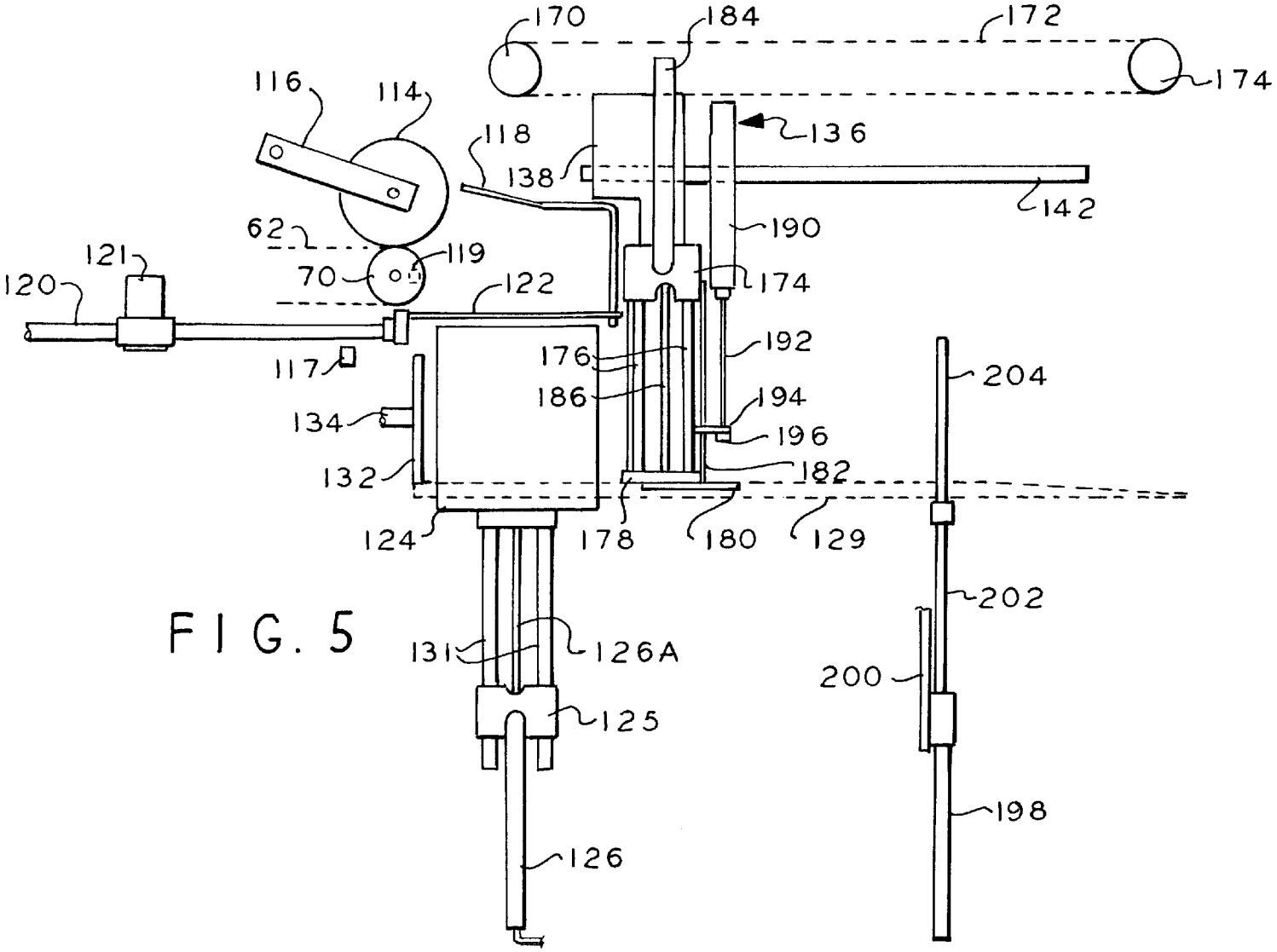
FIG. 5 is a schematic illustration of the downstream end of the system of FIG. 1.

A vertically reciprocatable table 124 is shown in FIG. 5 in an elevated position, downstream from and slightly below conveyor belts 62. Table 124 has the fork-like structure shown in FIG. 6 and includes a parallel pair of plate-like supports 124A and 124B. Table 124 is raised and lowered by the piston arm 126A of hydraulic cylinder 126. This cylinder is connected to an air/oil tank. The control media is air, and the motion media is non-compressible hydraulic oil. Table 124 is raised and lowered by the piston arm 126A of air cylinder 126 (FIGS. 1, 5 and 6) to cause supports 124A and 124B to slide through openings 126 in span 129. Cylinder 126 is supported on block 125 which is attached through plate 127 to beam 128 (FIG. 1). In turn, beam 128 is cantilevered from support 20. Span 129 is a steel gang plank with a central longitudinal groove 130. Span 129 extends downstream from a position below implement 122 to a tapered downstream end.

A pusher is shown herein as a vertical plate 132, which is horizontally reciprocated by air cylinder 134. Cylinder 134 is supported by block 135, which is attached to support 20 (FIG. 1). Pusher 132 is shown in its retracted position in FIGS. 1 and 5, but can extend and effectively ride along the top of span 129 in a manner to be described presently.

Referring to FIGS. 1, 5, 7 and 8, an engagement assembly is shown having a carriage assembly 136. Carriage assembly 136 has a flaf-shaped carriage plate 138 riding by means of linear bearing 140 on rail 142. Rail 142 is an elongate member attached to a fence 144 supported by previously mentioned support 20 and strut 146. Strut 146 is attached to previously mentioned cantilevered beam 128. A bridging arm 148 attached to the top of the carriage plate 138 carries a pair of rollers 150 that straddle fence 144 to prevent carriage plate 138 from rotating about rail 142. Brackets 147 are attached to fence 144 to support channel beam 152 and a number of position sensors 154, whose support brackets 156 can be unclamped to slide within channel 152 and thereby allow longitudinal repositioning of the sensors 154. Sensors 154 may employ Hall-effect crystals, although other transducer types may be used as well. Bridging arm 148 supports an upright probe 158 that can come into alignment with and sequentially trigger each of the sensors 154 as carriage plate 138 rides along rail 142. To accommodate electrical connections as the carriage moves, a cable shield 160 containing cables 162 extends from shelf 164, loops up, and attaches to bridging arm 148.

Carriage assembly 136 is moved along rail 142 by drive motor 166 (FIG. 1), which is attached to right angle drive 168, which is in turn supported by fence 144. Output pulley 170 of drive 168 circulates endless loop 172 around idler pulley 174 on bracket 147. Carriage 136 is attached to and longitudinally driven by endless loop 172.

The carriage assembly 136 also has a two-part mounting block 174 (FIGS. 7 and 8) for guiding slide bars 176, whose lower ends are attached to a footer 178, which supports a scoop 180. An upright slider 182 is attached in a position perpendicular to scoop 180, and adjacent to the downstream face of footer 178. An air cylinder 184 in block 174 has its piston rod 186 attached to footer 178 to vertically reciprocate scoop 180 relative to carriage plate 138.

A bracket 188 attached to block 174 supports an air cylinder 190 whose piston rod 192 is attached to a gripper 194 having on its underside a pair of elastomeric gripping bumpers 196. Gripper 194 is a plate having a C-shaped proximal end designed to slidably embrace upright slider 182.

An cylinder 198 (FIGS. 1 and 5) are attached by support plate 200 to cantilevered support beam 128. Their piston rods 202 are attached to stops 204 and act as vertically reciprocating stops. Stops 204 extend and retract through slots in span 129 on either side of groove 130.

A vertical guide plate 206 (FIGS. 1 and 8) extends along the length of span 129. Plate 206 has a fixed plate 206A adjacent to a jogger plate 206B. Fixed plate 206A is supported on a standard 208, which supports an adjustable support arm 210. Arm 210 also supports an electrically actuated jogging mechanism 212, which supports jogger plate 206B. Accordingly, jogging mechanism 212 and jogger plate 206B act as a jogger to laterally tap and straighten a stacked bundle arriving there.

The tapered, distal end of span 129 extends to the top of an automatic banding machine 214. Machine 214 has an arch 216 that can wrap a band (not shown) around a stacked bundle 218. An air cylinder 220 attached to the top of arch 216 has a presser 224 in the shape of a bar that can be vertically pressed upon bundle 218 to compress and steady it in preparation for banding.

Figure 9:
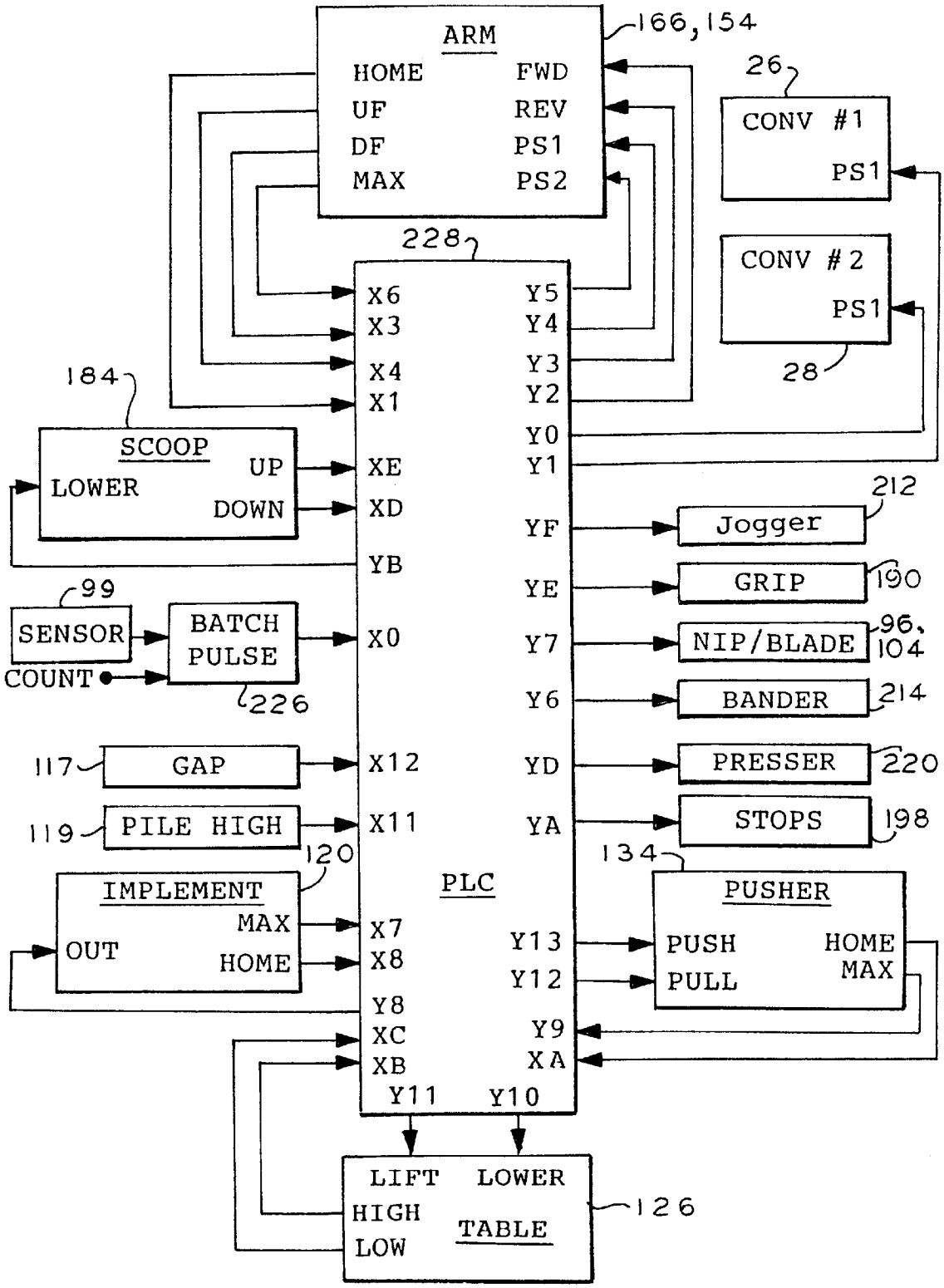
FIG. 9 is a schematic diagram of a controller associated with the system of FIG. 1.

Referring to FIG. 9, programmable logic controller 228 is a commercially available device that can be programmed with a variety of instructions that can perform logical operations on various inputs to produce control outputs. The control outputs may exist only for as long as the logical prerequisites prevail, or can be latched until reset by the onset of some other logical prerequisite. Instead of an immediate output, some instructions will produce a delayed output to incorporate a timing feature. The instructions can cause a response to the first occurrence (or conclusion) of a control input that follows some necessary, preceding event. Various process control systems are available to provide functions of this type. Alternatively, a microcomputer or other computing device can be used to monitor the control inputs and produce control outputs using any one of a variety of programming languages.

The previously mentioned robotic arm is moved longitudinally by previously mentioned motor 166 (FIG. 1). As shown in FIG. 9, motor 166 can be driven in either the forward (FWD) or reverse (REV) direction by outputs Y2 and Y3, respectively, from controller 228. Also, motor 166 can be driven at either one of two preset speeds (PS1 and PS2) by outputs Y4 and Y5, otherwise the motor will run at a predetermined normal speed.

Figure 8:
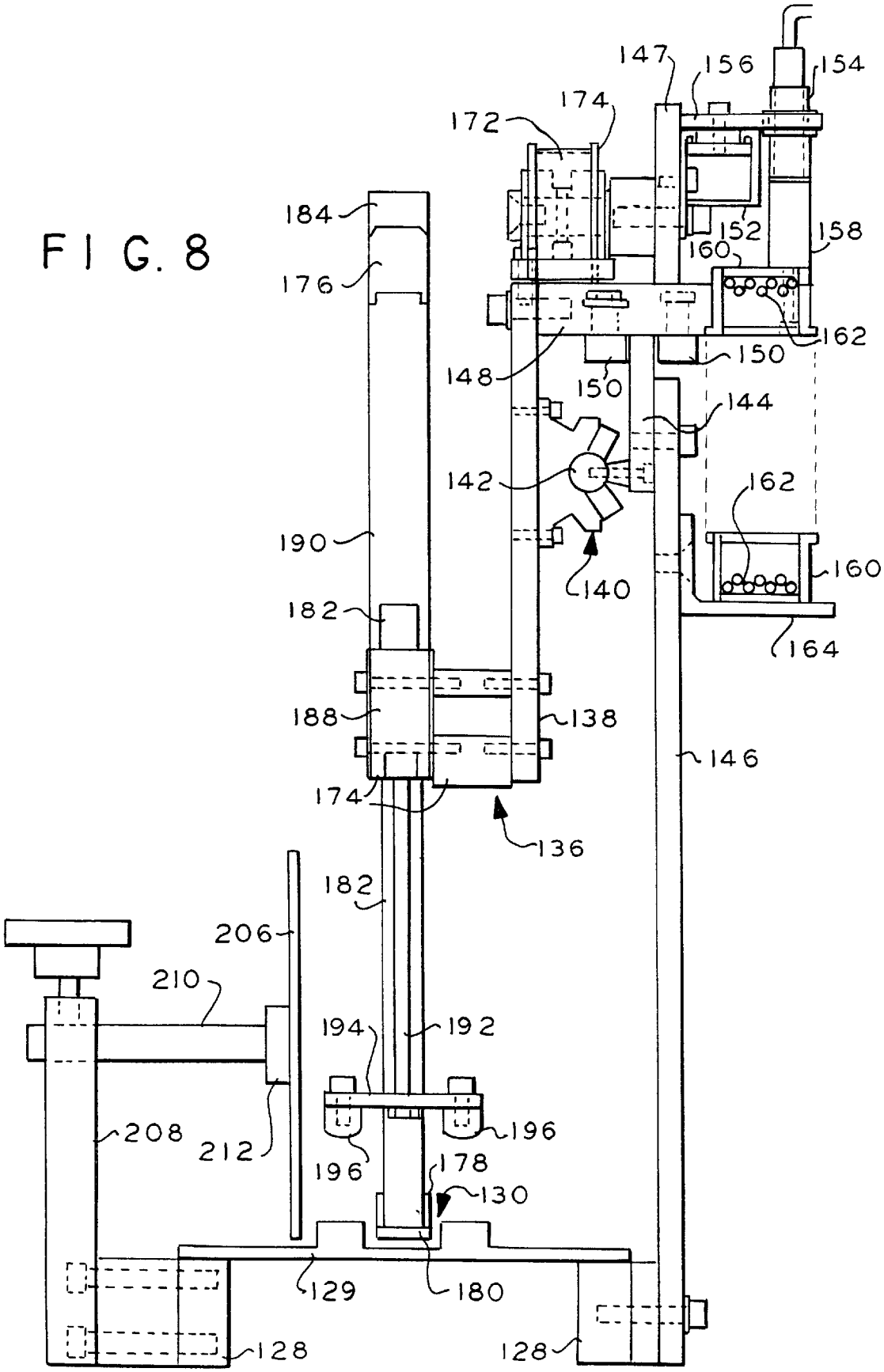
FIG. 8 is an end, elevational view of the robotic arm of FIG. 1.

In this embodiment four position sensors 154 (FIG. 1) will be set at four unique positions along channel 152 (FIG. 8). One of the sensors 154 will be at a home position corresponding to the starting upstream position for the robotic arm in order to apply a HOME signal to input X1 (FIG. 9) of controller 228. Another one of the sensors 154 will be set at a maximum position corresponding to the maximum downstream position for the robotic arm in order to apply a MAX signal to input X6 of controller 228. Two other sensors 154 will be set at intermediate positions corresponding to locations of the robotic arm where it is desirable to adjust arm speed or lower and raise the previously mentioned gripper 194/196, by sending a location signal DF and UF to inputs X3 and X4, respectively, of controller 228.

Previously mentioned scoop cylinder 184 (FIGS. 5 and 9) can be operated by output YB of controller 228. Proximity sensors (not shown) detect whether scoop cylinder 184 is in the full up or full down position to apply corresponding signals to inputs XE or XD, respectively.

Goods being supplied to the apparatus of FIG. 1 are counted by device 226 which receives a COUNT pulse signal from an upstream process (for example a rotary die cutter) that is producing goods. Device 226 is preprogrammed to produce a batch pulse every time the count increases by a predetermined increment. Counting starts with the creation of a gap as sensed by previously mentioned sensor 99 (shown coupled to device 226 in FIG. 9). Also, previously mentioned sensors 119 and 117 (FIG. 5) apply their signals to inputs X11 and X12, respectively, of controller 228.

Previously mentioned implement cylinder 120 (FIGS. 5 and 9) can be operated by output Y8 of controller 228. Proximity sensors (not shown) detect whether implement cylinder 120 is in the fully extended or fully retracted (home) position to apply corresponding signals to inputs X7 or X8, respectively.

Previously mentioned table cylinder 126 (FIGS. 5 and 9) can be operated to lower or lift table 124 by producing control signals on outputs Y10 and Y11, respectively, of controller 228. Proximity sensors (not shown) detect whether table cylinder 184 is in the full up or full down position to apply corresponding signals to inputs XB or XC, respectively.

Previously mentioned pusher cylinder 134 (FIGS. 5 and 9) can be operated to retract or extend pusher 132 by applying a signal to outputs Y12 and Y13, respectively, of controller 228. Proximity sensors (not shown) detect whether pusher cylinder 134 is in the fully extended or fully retracted (home) position by applying corresponding signals to inputs X9 or XA, respectively.

Controller 228 also provides the following outputs: output signal YA to extend previously mentioned stop cylinder 198 (FIG. 5); output signal YD to operate presser cylinder 220 and lower presser bar 224 (FIG. 1); output signal Y6 to operate automatic banding machine 214 (FIG. 1); output signal Y7 to operate nip cylinder 96 and blade cylinder 104 (FIG. 1); output signal YE to operate gripper cylinder 190 (FIG. 5) and lower gripper 194/196; and output signal YF to operate jogger mechanism 212 (FIG. 1).

The upstream conveyor motor 26 and the downstream conveyor motor 28 (FIG. 1) normally operate at the same preselected speed (synchronized to incoming product flow rate). Controller 228 can produce a signal Y1 that is applied to the preset-speed input PS1 to decelerate motor 26 to a predetermined lower speed. Controller 228 can also produce a signal Y0 that is applied to the preset-speed input PS1 to accelerate motor 28 to a predetermined higher speed.

To facilitate an understanding of the principles associated with the foregoing apparatus, its operation will be briefly described with reference to the foregoing Figures as well as the schematic diagrams of FIGS. 10A–10D. In the following description goods are being produced by a rotary cutter or other machine (not shown) upstream of conveyor section 40 (FIG. 1). Initially, section 40 is elevated to the position shown in phantom so that goods do not reach the system of FIG. 1 and are diverted as a waste stream. When an operator is ready to count and bundle goods, cylinder 42 is operated to lower section 40 to the position shown in full in FIG. 1. Consequently, a stream of shingled goods 227 arrives on conveyor section 40.

Figure 2:
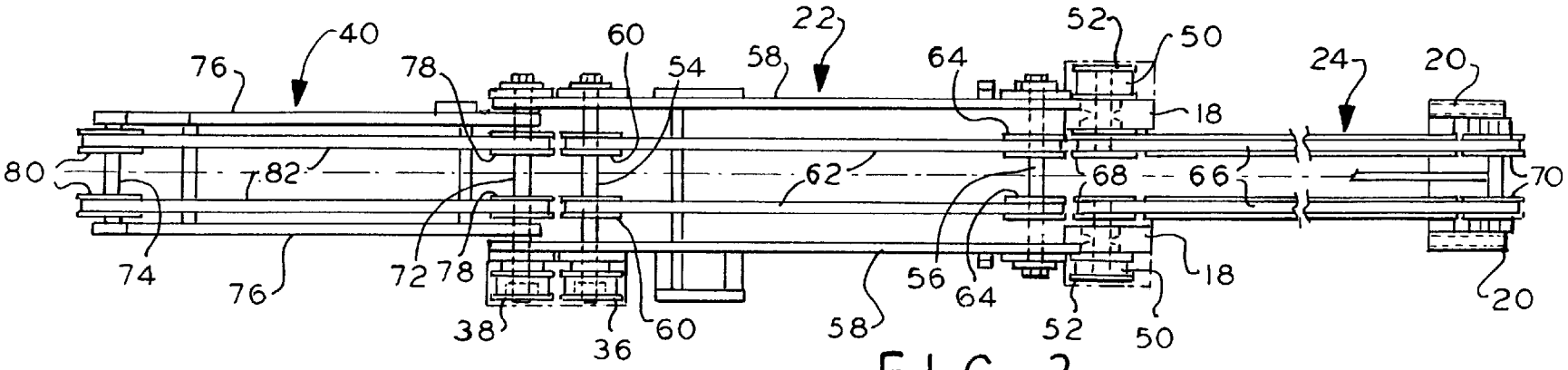
FIG. 2 is a plan view of the conveyor assembly of FIG. 1.

With motors 26 and 28 operating at the same speed, the shingled stream of goods flow across section 40 to section 22 and then onto section 24. Specifically, motor 26 circulates belt 34 to drive pulleys 36 and 38, which circulates conveyor belts 82 and 62 (FIGS. 1 and 2). Motor 28 circulates belt 50 to drive pulleys 52, which circulates conveyor belts 66.

Eventually, the leading edge of the single shingled stream 227 reaches infrared sensor 99 (FIG. 4) to interrupt its infrared beam. Sensor 99 applies a signal to batch pulse generator 226 (FIG. 9), which then begins counting. In this embodiment the counting signal is supplied by a proximity sensor on the cutting head of the rotary cutter (not shown), which is supplying product to the system.

Figure 10A:
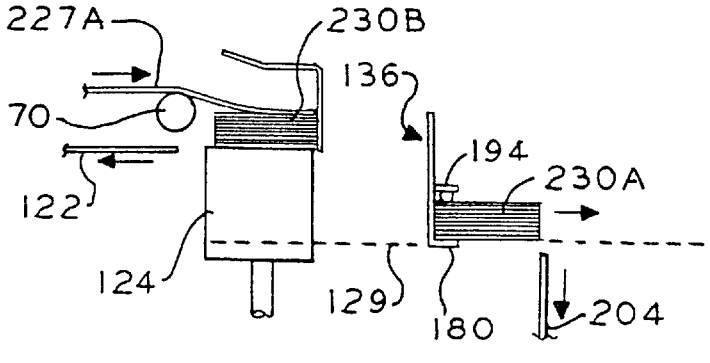
FIGS. 10A–10D are schematic illustrations of the handling of goods by the system of FIG. 1 discharged from the conveyor assembly.

The shingled stream eventually passes under nip rollers 114 (FIGS. 1 and 5) and is stopped from further forward movement by guide 118. Consequently, the goods form a bundled stack 230B atop table 124 as shown in FIG. 10A. Implements 122 are shown retracted since table 124 has recently reached its highest position. A previously stacked bundle 230A is shown engaged by carriage assembly 136 of the engagement means. Scoop 180 is inserted under the stack while gripper 194 is pressed on the top of the stack. Stack 230A is being moved downstream by the carriage assembly 136.

As stack 230B grows, sensor 119 (FIG. 5) detects an excessive height and applies an input signal to input X11 of controller 228 (FIG. 9). Controller 228 produces an output signal on output Y10 to lower table 124 until the input X11 indicates that the stack height is no longer excessive. Consequently, the table 124 gradually descends as the stack grows.

Eventually, batch pulse generator 226 (FIG. 9) produces a pulse at input X0, indicating the desired count has been achieved for a bundle. One-half second later controller 228 changes the speeds of motors 26 and 28 by producing control signals at outputs Y0 and Y1. Specifically, the speed of motor 26 and is halved, while the speed of motor 28 is doubled. Consequently, conveyor sections 22 and 40 decelerate while conveyor section 24 accelerates. At about the same time, controller 228 produces an output signal at output Y7 to operate cylinders 96 and 104 (FIG. 4). In response, blade 108 descends to stop upstream stream 110, while nip roller 100 descends onto conveyor 62 to help accelerate downstream stream 112. The resulting gap shown in FIG. 4 is allowed to expand for about one-half second to create a 12 inch (30.5 cm) gap. Thereafter, cylinders 104 and 96 are released to allow blade 108 and nip rollers 100 to rise. Simultaneously, motors 26 and 28 are returned to their normal speed so that streams 110 and 112 travel at the same speed.

Figure 10B:
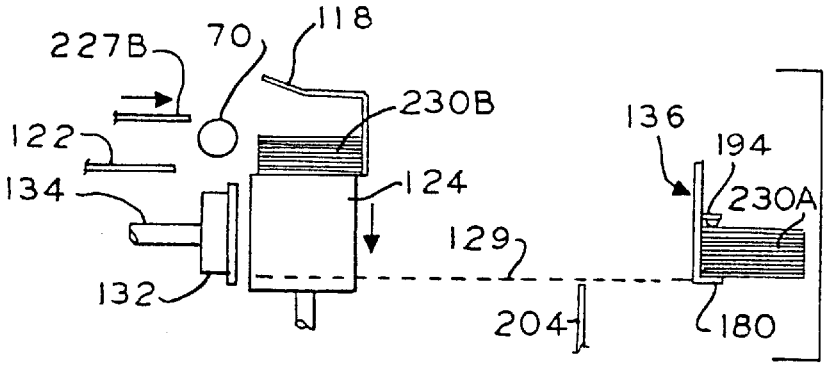

Eventually the gap between streams 110 and 112 reaches sensor 117 (FIG. 5) to apply a signal to input X12 of controller 228 (FIG. 9). In response, controller 228 produces an output signal at output Y10 to operate cylinder 126 and lower table 124 as shown in FIG. 10B, until fully lowered as indicated by a low signal at input XC. One-half second after table 124 begins its descent, controller 228 produces an output signal at output Y8 to operate cylinder 120 and extend implements 122; until a maximum signal is received at input X7, indicating the implements 122 are fully extended.

Figure 10C:
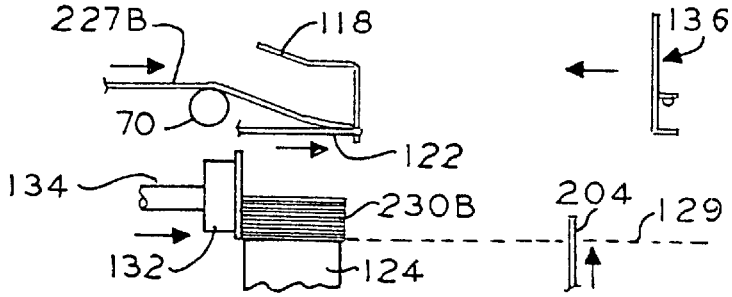

As shown in FIG. 10C new stream 227B now falls onto implements 122 to begin a new bundle. Also shown is the fully lowered position of table 124. Controller 228 detects this lowered position from the low signal received at input XC and then produces a push signal at output Y13 to operate cylinder 134 so that pusher 132 begins moving as shown in FIG. 10C. At the same time, controller 228 produces an output signal at output YA to operate cylinder 198 and raise stops 204, as also shown in this Figure.

Figure 10D:
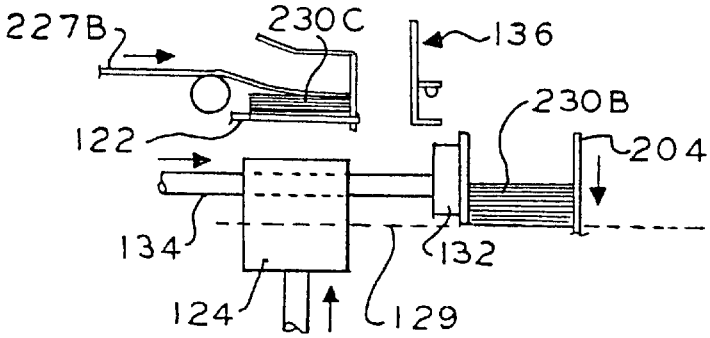

Pusher 132 pushes stacked bundle 230B along span 129 until it reaches stops 204, which are now fully deployed at shown in FIG. 10D. Controller 228 immediately reverses the direction of pusher 132 when a full pusher extension signal is detected at input X9. Simultaneously, controller 228 retracts stops 204 and also elevates table 124 (until a high signal is received at input XB).

Significantly, the two table supports 124A and 124B (FIG. 6) straddle the piston rod 134 of pusher 132. Therefore, the top of table 124 can rise above the pusher 132/134 without interference. In fact, the distal pusher element 132 can itself slide between the supports 124A and 124B without interference. Thus, the table can return promptly because it need not await full retraction of the pusher. When table 124 has risen to its full height, controller 228 retracts implements 122 to return to the condition shown in FIG. 10A.

The foregoing described the handling of bundle 230B, without fully commenting on the handling of prior bundle 230A. FIG. 10D shows bundle 230B pushed against stops 204, which stops are in the process of descending. In FIG. 10A, prior bundle 230A had already reached that position (and the stops were fully lowered). Accordingly, the handling of bundle 230A illustrated in FIGS. 10A–10D also represents the handling that bundle 230B would receive, even though that handling is not explicitly illustrated. It is significant to note, however, that these processes are occurring in parallel. This greatly enhances the throughput of the system.

Controller 228 moves carriage assembly 136 to the position shown in FIG. 10A through several discrete motions.

First, scoop 180 is lowered when full retraction of pusher 132 is detected by a home signal on input XA. The initial lowering of scoop 180 occurs at a position upstream of the location shown in FIG. 10A for bundle 230A. Controller 228 allows this lowering of scoop 180 only when the robotic arm is in the home position as indicated by a home signal at input X1. This home signal is produced by the position sensor 154 (FIG. 1) that is located in the most upstream position. Also, when the scoop 180 is fully lowered as indicated by the signal at input XD, controller 228 operates jogger 212 for a predetermined interval (for example, until the robotic arm moves a predetermined distance).

Once the scoop 180 is fully lowered, controller 228 produces on output Y2 a signal that commands motor 166 to send carriage assembly 136 forward (downstream direction). Eventually scoop 180, traveling inside groove 130 goes under bundle 230A. As carriage assembly 136 moves forward it eventually triggers another one of the position sensors 154 to apply signal DF to input X3 (FIG. 9). In response, controller 228 produces a signal on output YE to activate cylinder 190 and bring gripper 194 down to the position shown in FIG. 10A. Controller 228 keeps gripper 194 down for 0.2 seconds or until carriage assembly 136 reaches another overriding sensor 154.

Carriage assembly 136 stops at a maximum forward position when a corresponding position sensor 154 applies a limit signal to input X6. This forward motion of the bundle can displace a prior bundle that may still be located in the automatic banding machine 214. Around this time, controller 228 produces a signal on output YD to lower presser bar 224 to compress and remove air out of the bundle 230A. Simultaneously, controller 228 produces a signal on output Y6 to operate automatic banding machine 214, which starts its operation after a predetermined, internal delay.

Controller 228 now sends a signal on output Y3 to reverse the direction of motor 166 and move carriage 136 in an upstream direction. At the same time, gripper 194 is raised. Eventually, carriage assembly 136 returns to the home position shown in FIG. 10D. Throughout these operations, the speed of motor 166 can be automatically adjusted. For example, the speed is reduced as the scoop 180 approaches the stacked bundle to avoid a hard impact. Other speed adjustments can be made by dictating a speed change as the longitudinal position of the robotic arm changes.

The foregoing cycle can repeat indefinitely to automatically produce multiple bundles of goods having a predetermined count.

It is appreciated that various modifications may be implemented with respect to the above described, preferred embodiment. Goods may be supplied by a variety of machines other than a rotary cutter. Also the final stage may be a machine other than an automatic banding machine; or no machine may be used at the end and the bundled goods may simply be collected. Furthermore, the various steps disclosed herein may be performed with a different sequence or timing, where steps may be delayed, accelerated, supplemented or eliminated. Also, the gap may be created by all or only some of the devices illustrated herein. These devices may be swung on arms as shown, may be vertically reciprocated, or moved in some other fashion. Furthermore, embodiments employing a pair of conveyors may change the speed of only one conveyor. Moreover, the robotic arm may have any one of a variety of carriages that are supported by chains, underlying rails, articulated arms, or other means. In still other embodiments the robotic arm may have a gripper that is supported on a lever, or may be eliminated completely. While a number of pneumatic cylinders are illustrated, in other embodiments these may be actuated electromagnetically, hydraulically, or by other means. While the illustrated conveyors each uses a pair of parallel belts, in other embodiments a different number of belts or a single belt may be employed. Also, the table may be cantilevered on a single support that may extend upwardly to an actuator, or may be elevated by a scissor mechanism, hoisting cables, etc.

Obviously, many modifications and variations of the present invention are possible in light of the above teachings. It is therefore to be understood that within the scope of the appended claims, the invention may be practiced otherwise than as specifically described.

What is claimed is:

1. Bundling system for converting a shingled stream of goods into successive bundles of goods, comprising:

a conveyor assembly having an upstream and a downstream section for (a) longitudinally passing the shingled stream of goods from said upstream to said downstream section, and (b) repeatedly interrupting passage of goods for creating a gap in said shingled stream of goods;

a reciprocatable table located downstream of said conveyor assembly for detaining and collecting goods there into a stacked bundle, and a pusher for extending and pushing said stacked bundle off said table, said table being operable to move elevationally and bring said stacked bundle next to said pusher, said table being operable, without interference, to move elevationally away from a position next to said pusher while said pusher is extended in order to push said stacked bundle.

2. Bundling system according to claim 1 wherein, repeatedly, the speed of said downstream section relative to said upstream section is temporarily increased to facilitate the gap in said shingled goods.

3. Bundling system according to claim 2 comprising:

an upstream and a downstream drive motor coupled to said upstream and said downstream section, respectively, for independently driving them.

4. Bundling system according to claim 3 wherein said upstream and said downstream section each comprise at least one endless conveyor belt.

5. Bundling system according to claim 1 comprising:

a reciprocating blade operable for repeated insertion in said stream of shingled goods at a location between said downstream and said upstream section to facilitate the gap in said shingled goods.

6. Bundling system according to claim 5 wherein the speed of said downstream section relative to said upstream section is temporarily increased in synchronism with said reciprocating blade to facilitate the gap in said shingled goods.

7. Bundling system according to claim 6 comprising:

a nip roller adjacent to said reciprocating blade for repeatedly rising over and descending upon said shingled stream of goods in synchronism with said reciprocating blade.

8. Bundling system according to claim 1 wherein said pusher is operable upon said table elevationally moving to a preset elevation to extend fully and immediately retract.

9. Bundling system according to claim 1 wherein said table is operable to keep said stacked bundle, as it grows, below a predetermined elevation.

10. Bundling system according to claim 1 comprising:

a span for supporting said stacked bundle, said pusher being operable to longitudinally push said stacked bundle along said span.

11. Bundling system according to claim 1 wherein said table has at least a pair of supports for straddling said pusher while extended, without interference.

12. Bundling system according to claim 11 comprising:

a span for supporting said stacked bundle, said pusher being operable to longitudinally push said stacked bundle along said span, said span having at least one opening for allowing upward passage of said table through said span.

13. Bundling system according to claim 1 comprising:

a controller coupled to said table and said pusher, said table being operable by said controller to elevationally move said pusher has extended to push said stacked bundle.

14. Bundling system according to claim 1 comprising:

a reciprocating implement for temporarily extending over said table to catch and collect goods there.

15. Bundling system according to claim 14 comprising:

a guide for restricting longitudinal motion of said shingled stream of goods leaving said downstream section of said conveyor assembly to form said stacked bundle.

16. Bundling system according to claim 14 wherein said implement is operable to retract in response to said table elevationally moving to a position adjacent said implement.

17. Bundling system according to claim 1 comprising:

an engagement assembly for engaging said stacked bundle and moving it further downstream after being pushed by said pusher.

18. Bundling system according to claim 17 wherein said engagement assembly comprises:

a scoop moveable in a downstream direction to subjacently engage said stacked bundle.

19. Bundling system according to claim 1 comprising:

a banding machine located downstream of said pusher for banding said stacked bundle.

20. Bundling system according to claim 19 comprising:

a vertically reciprocatable presser located downstream of said pusher for holding said stacked bundle at said banding machine.

21. Bundling system for converting a shingled stream of goods into successive bundles of goods, comprising:

a conveyor assembly having an upstream and a downstream section for (a) longitudinally passing the shingled stream of goods from said upstream to said downstream section, and (b) repeatedly interrupting passage of goods for creating a gap in said shingled stream of goods;

a reciprocatable table located downstream of said conveyor assembly for detaining and collecting goods there into a stacked bundle;

a pusher for extending and pushing said stacked bundle off said table;

a reciprocating implement for temporarily extending over said table to catch and collect goods there, said implement being operable to retract in response to said table rising to a position adjacent said implement; and a gap sensor located at said downstream section for producing a gap signal upon said gap approaching said table, said implement being responsive to said gap sensor for extending in response to said gap signal.

22. Bundling system for converting a shingled stream of goods into successive bundles of goods, comprising:

a conveyor assembly having an upstream and a downstream section for (a) longitudinally passing the shingled stream of goods from said upstream to said downstream section, and (b) repeatedly interrupting passage of goods for creating a gap in said shingled stream of goods;

a reciprocatable table located downstream of said conveyor assembly for detaining and collecting goods there into a stacked bundle; and a pusher for extending and pushing said stacked bundle off said table, said table being operable to descend and bring said stacked bundle next to said pusher; and a reciprocating stop for moving into alignment with said pusher in response to extension of said pusher in order to limit motion of said stacked bundle.

23. Bundling system according to claim 22 wherein said reciprocating stop is operable to move out of alignment with said pusher after full extension of said pusher.

24. Bundling system according to claim 23 comprising:

a span for supporting said stacked bundle, said pusher being operable to longitudinally push said stacked bundle along said span, said span having at least one opening for allowing upward passage of said stop through said span.

25. Bundling system for converting a shingled stream of goods into successive bundles of goods, comprising:

a conveyor assembly having an upstream and a downstream section for (a) longitudinally passing the shingled stream of goods from said upstream to said downstream section, and (b) repeatedly interrupting passage of goods for creating a gap in said shingled stream of goods;

a reciprocatable table located downstream of said conveyor assembly for detaining and collecting goods there into a stacked bundle;

a pusher for extending and pushing said stacked bundle off said table;

an engagement assembly for engaging said stacked bundle and moving it further downstream after being pushed by said pusher, said engagement assembly comprising a scoop moveable in a downstream direction to subjacently engage said stacked bundle; and a span for supporting said stacked bundle, said pusher being operable to longitudinally push said stacked bundle along said span, said span having a longitudinal groove for facilitating insertion of said scoop under said stacked bundle.

26. Bundling system for converting a shingled stream of goods into successive bundles of goods, comprising:

a conveyor assembly having an upstream and a downstream section for (a) longitudinally passing the shingled stream of goods from said upstream to said downstream section, and (b) repeatedly interrupting passage of goods for creating a gap in said shingled stream of goods;

a reciprocatable table located downstream of said conveyor assembly for detaining and collecting goods there into a stacked bundle;

a pusher for extending and pushing said stacked bundle off said table;

an engagement assembly for engaging said stacked bundle and moving it further downstream after being pushed by said pusher, said engagement assembly comprising a scoop moveable in a downstream direction to subjacently engage said stacked bundle, said scoop being vertically reciprocatable and operable to descend before subjacently engaging said stacked bundle.

27. Bundling system according to claim 26 wherein said engagement assembly comprises:

a gripper arranged to vertically reciprocate relative to said scoop in order to grip said stacked bundle between said gripper and said scoop.

28. Bundling system according to claim 27 comprising:

a controller coupled to said scoop and said gripper for operating them, said controller moving said scoop to a predetermined downstream position and causing said gripper to descend.

29. Bundling system according to claim 28 wherein said controller moves said scoop from said predetermined downstream position to a predetermined release position before causing said gripper to rise.

30. Bundling system according to claim 29 wherein said controller moves said scoop upstream of said predetermined release position and causes said scoop and gripper to rise.

31. Bundling system according to claim 27 comprising:

a jogger downstream of said pusher for laterally pressing said stacked bundle.

32. Bundling system according to claim 31 comprising:

a controller coupled to said jogger and said scoop for actuating said jogger after lowering said scoop.

33. Bundling system according to claim 27 comprising:

a controller coupled to said gripper, said scoop, and said downstream and said upstream sections of said conveyor assembly for controlling them.

34. Bundling system according to claim 33 comprising:

a vertically reciprocatable presser located downstream of said pusher for holding said stacked bundle after being dealt with by said scoop.

35. Bundling system according to claim 33 comprising:

a reciprocating stop coupled to and controlled by said controller in order to limit motion of said stacked bundle, said controller being operable to move said stop into alignment with said pusher after extending said pusher; and a reciprocating implement coupled to and controlled by said controller for temporarily extending over said table to catch and collect goods there.

36. Bundling system according to claim 35 comprising:

a jogger downstream of said pusher coupled to and controlled by said controller for laterally pressing said stacked bundle.

37. Bundling system according to claim 26 comprising:

a controller coupled to said scoop and said pusher for operating them, said controller lowering said scoop after causing said pusher to begin retracting.

38. Bundling system according to claim 37 wherein said controller moves said scoop in a downstream direction after lowering said scoop.

39. Bundling system according to claim 38 wherein after lowering said scoop said controller causes said scoop to move downstream, pause, and move upstream.

40. Bundling system according to claim 38 wherein after lowering said scoop said controller causes said scoop to move downstream, pause, and move upstream at a first speed, and after a predetermined delay, at a second speed.

41. Bundling system according to claim 26 wherein said engagement assembly comprises:

an elongate member, said scoop being supported by said elongate member.

42. Bundling system according to claim 41 wherein said engagement assembly comprises:

a carriage assembly riding and being supported by said elongate member, said carriage assembly being operable to vertically reciprocate said scoop.

43. Bundling system according to claim 42 wherein said carriage assembly comprises:

a gripper arranged to vertically reciprocate relative to said scoop in order to grip said stacked bundle between said gripper and said scoop.

44. Bundling system according to claim 43 wherein said engagement assembly comprises:

an endless loop coupled to said carriage assembly for moving it along said elongate member.

45. Bundling system for converting a shingled stream of goods into successive bundles of goods, comprising:

a conveyor assembly for longitudinally passing the shingled stream of goods in a downstream direction;

a reciprocatable table located downstream of said conveyor assembly for detaining and collecting goods there into a stacked bundle;

a pusher for extending and pushing said stacked bundle off said table, said reciprocatable table being arranged to move elevationally past said pusher without interference when said pusher is extended, said table being operable to move elevationally and bring said stacked bundle next to said pusher; and a controller coupled to said table and said pusher, said table being operable by said controller to move elevationally after said pusher has extended to push said stacked bundle.

46. Bundling system according to claim 45 comprising:

a reciprocating blade operable for repeated insertion in said stream of shingled goods on said conveyor assembly to facilitate creation of a gap in said shingled goods.

47. Bundling system according to claim 46 comprising:

a nip roller adjacent to said reciprocating blade for repeatedly rising over and descending upon said shingled stream of goods in synchronism with said reciprocating blade.

48. Bundling system according to claim 45 wherein said pusher is operable upon said table elevationally moving a preset elevation to extend fully and immediately retract.

49. Bundling system according to claim 45 wherein said table is operable to keep said stacked bundle, as it grows, below a predetermined elevation.

50. Bundling system according to claim 45 comprising:

a reciprocating implement for temporarily extending over said table to catch and collect goods there.

51. Bundling system according to claim 50 wherein said implement is operable to retract in response to said table elevationally moving to a position adjacent said implement.

52. Bundling system according to claim 45 comprising:

an engagement assembly for engaging said stacked bundle and moving it further downstream after being pushed by said pusher.

53. Bundling system according to claim 52 wherein said engagement assembly comprises:

a scoop moveable in a downstream direction to subjacently engage said stacked bundle.

54. Bundling system for converting a shingled stream of goods into successive bundles of goods, comprising:

a conveyor assembly for longitudinally passing the shingled stream of goods in a downstream direction;

a reciprocatable table located downstream of said conveyor assembly for detaining and collecting goods there into a stacked bundle; and a pusher for extending and pushing said stacked bundle off said table, said reciprocatable table being arranged to move elevationally past said pusher without interference when said pusher is extended, said table having at least a pair of supports for straddling said pusher while extended, without interference.

55. Bundling system according to claim 54 comprising:

a span for supporting said stacked bundle, said pusher being operable to longitudinally push said stacked bundle along said span, said span having at least one opening for allowing upward passage of said table through said span.

56. Bundling system for converting a shingled stream of goods into successive bundles of goods, comprising:

a conveyor assembly for longitudinally passing the shingled stream of goods in a downstream direction;

a reciprocatable table located downstream of said conveyor assembly for detaining and collecting goods there into a stacked bundle;

a pusher for extending and pushing said stacked bundle off said table, said reciprocatable table being arranged to rise past said pusher without interference when said pusher is extended;

an engagement assembly for engaging said stacked bundle and moving it further downstream after being pushed by said pusher, said engagement assembly comprising a scoop moveable in a downstream direction to subjacently engage said stacked bundle; and a span for supporting said stacked bundle, said pusher being operable to longitudinally push said stacked bundle along said span, said span having a longitudinal groove for facilitating insertion of said scoop under said stacked bundle.

57. Bundling system for converting a shingled stream of goods into successive bundles of goods, comprising:

a conveyor assembly for longitudinally passing the shingled stream of goods in a downstream direction;

a reciprocatable table located downstream of said conveyor assembly for detaining and collecting goods there into a stacked bundle;

a pusher for extending and pushing said stacked bundle off said table, said reciprocatable table being arranged to rise past said pusher without interference when said pusher is extended;

an engagement assembly for engaging said stacked bundle and moving it further downstream after being pushed by said pusher, said engagement assembly comprising a scoop moveable in a downstream direction to subjacently engage said stacked bundle, said scoop being vertically reciprocatable and operable to descend before subjacently engaging said stacked bundle.

58. Bundling system according to claim 57 wherein said engagement assembly comprises:

a gripper arranged to vertically reciprocate relative to said scoop in order to grip said stacked bundle between said gripper and said scoop.

59. Bundling system according to claim 58 comprising:

a controller coupled to said scoop and said gripper for operating them, said controller moving said scoop to a predetermined downstream position and causing said gripper to descend.

60. Bundling system according to claim 57 comprising:

a controller coupled to said scoop and said pusher for operating them, said controller lowering said scoop after causing said pusher to begin retracting.

61. Bundling system according to claim 60 wherein said controller moves said scoop in a downstream direction after lowering said scoop.

62. Bundling system according to claim 61 wherein after lowering said scoop said controller causes said scoop to move downstream, pause, and move upstream.

* * * * *